US008443717B2

(12) United States Patent
Venturi

(10) Patent No.: US 8,443,717 B2
(45) Date of Patent: May 21, 2013

(54) CAPSULE FOR PREPARING DRINKS

(75) Inventor: Roberto Degli Esposti Venturi, Gaggio Montano (IT)

(73) Assignee: Caffita Systems S.p.A. (IT)

( * ) Notice: Subject to any disclaimer, the term of this patent is extended or adjusted under 35 U.S.C. 154(b) by 624 days.

(21) Appl. No.: 12/595,182

(22) PCT Filed: Apr. 11, 2008

(86) PCT No.: PCT/IB2008/051393

§ 371 (c)(1),
(2), (4) Date: Dec. 17, 2009

(87) PCT Pub. No.: WO2008/126045

PCT Pub. Date: Oct. 23, 2008

(65) Prior Publication Data

US 2010/0108541 A1 May 6, 2010

(30) Foreign Application Priority Data

Apr. 13, 2007 (EP) ..... 07425213

(51) Int. Cl.
*A47J 31/06* (2006.01)
*B65B 29/02* (2006.01)

(52) U.S. Cl.
USPC ..... 99/295; 426/77

(58) Field of Classification Search
USPC ..... 99/295, 323; 426/77, 115, 433; 219/689
See application file for complete search history.

(56) References Cited

U.S. PATENT DOCUMENTS

| | | | | |
|---|---|---|---|---|
| 2,778,739 | A * | 1/1957 | Rodth | 426/77 |
| 5,064,980 | A * | 11/1991 | Grossman et al. | 219/689 |
| 7,552,672 | B2 * | 6/2009 | Schmed | 99/295 |
| 7,624,673 | B2 * | 12/2009 | Zanetti | 99/295 |

FOREIGN PATENT DOCUMENTS

| | | | |
|---|---|---|---|
| BE | 571 720 | A | 4/1959 |
| DE | 202005021160 | U1 | 4/2007 |
| EP | 0309708 | A1 | 4/1989 |
| EP | 0 512 470 | A1 | 11/1992 |
| EP | 0521510 | A1 | 1/1993 |
| EP | 0806373 | A1 | 11/1997 |
| EP | 1 344 722 | A1 | 9/2003 |
| FR | 1 214 364 | A | 4/1960 |
| FR | 1 347 892 | A | 1/1964 |

* cited by examiner

*Primary Examiner* — Kien Nguyen
(74) *Attorney, Agent, or Firm* — Maginot, Moore & Beck, LLP

(57) ABSTRACT

A capsule for preparing drinks by passing a liquid through a powdered substance (9) contained in a chamber (8) made in the capsule (1). The chamber (8) is delimited on at least one side by at least one filter element (7) having a plurality of through-holes (12) extending from a first face (13) of the filter element (7) facing the inside of the chamber (8), to a second face (14) of the filter element (7). At least at the first face (13), the through-holes (12) have inlet sections (15) extending according to a main trajectory of extension and each having a length, measured along the main trajectory of extension, greater than their width, measured transversally to the main trajectory of extension.

20 Claims, 8 Drawing Sheets

CAPSULE FOR PREPARING DRINKS

REFERENCE TO PRIORITY APPLICATION

The present application is the national stage entry into the United States of International Application Number PCT/IB2008/0512393, filed Apr. 11, 2008, which claims priority to European Patent Application Number 07425213.1, filed Apr. 13, 2007, in the name of the present inventor.

BACKGROUND

The present invention relates to a capsule for preparing drinks of the type containing a powdered substance which, when a liquid (such as hot water) passes through it, produces the drink.

In particular the present invention is intended for the coffee preparation sector. Therefore, although it shall be understood that the present invention is applicable for preparing any drink (using a specific powder contained in the capsule and a specific liquid injected through the powder) the following description refers mainly to coffee, where the powder contained in the capsule is coffee powder and the liquid used is hot water (more or less pressurised depending on the type of coffee to be obtained—espresso, filter coffee, cream coffee).

At present there are many prior art types of capsules for preparing coffee. For example, those described in patents U.S. Pat. No. 4,136,202 and EP 1 344 722.

In general, most capsules have a container element with a lateral wall (in many cases having the shape of a truncated cone) joined and/or connected to a base wall and an upper wall.

In practice, the hot water is injected into the capsule through the upper wall, whilst the drink obtained flows out through the base wall (however, in some cases this operation is inverted, or the lateral wall is pierced). For this reasons, both the base wall and the upper wall have suitable openings which can be made either during the capsule production step, or at the moment when the capsule is used.

SUMMARY

The present invention is intended in particular for application to the type of capsules equipped with an internal filter element having a plurality of through-holes and which separates the coffee powder from the opening through which the drink flows out of the capsule.

At present there are substantially two types of filters.

The first type consists of filters made of paper or fabric through which only the drink and not the coffee powder can filter.

However, said type of filters cannot provide suitable mechanical strength without using relatively expensive supporting structures.

The second type of filters consists of filters which are normally semi-rigid and obtained by moulding a plastic material, having a plurality of through-holes with a circular cross-section and a diameter such that they substantially prevent the passage of most of the coffee powder (see for example patent EP 1 344 722).

As already indicated, the present invention is intended for this type of filters, since in the Applicant's experience such filters are subject to clogging and therefore preventing correct preparation and dispensing of the drink. If some holes are blocked, the distribution of the water in the capsule is affected and not all of the coffee powder is wet in the same way, meaning that the quality of the coffee may be lower than that expected.

In this situation, the technical purpose which forms the basis of the present invention is to provide a capsule for preparing drinks which overcomes the above-mentioned disadvantages.

In particular, the technical purpose of the present invention is to provide a capsule for preparing drinks which has a filter element with a plurality of through-holes that are not subject to clogging as in the capsules currently known.

The technical purpose specified and the aims indicated are substantially achieved by a capsule for preparing drinks as described in the claims herein.

DESCRIPTION OF THE FIGURES

Further features and advantages of the present invention are more apparent in the detailed description below, with reference to several preferred, non-limiting embodiments of a capsule for preparing drinks, illustrated in the accompanying drawings, in which.

DESCRIPTION OF THE PRESENT INVENTION

With reference to the accompanying drawings, the numeral 1 denotes a capsule for preparing drinks in accordance with the present invention.

Figure 1:
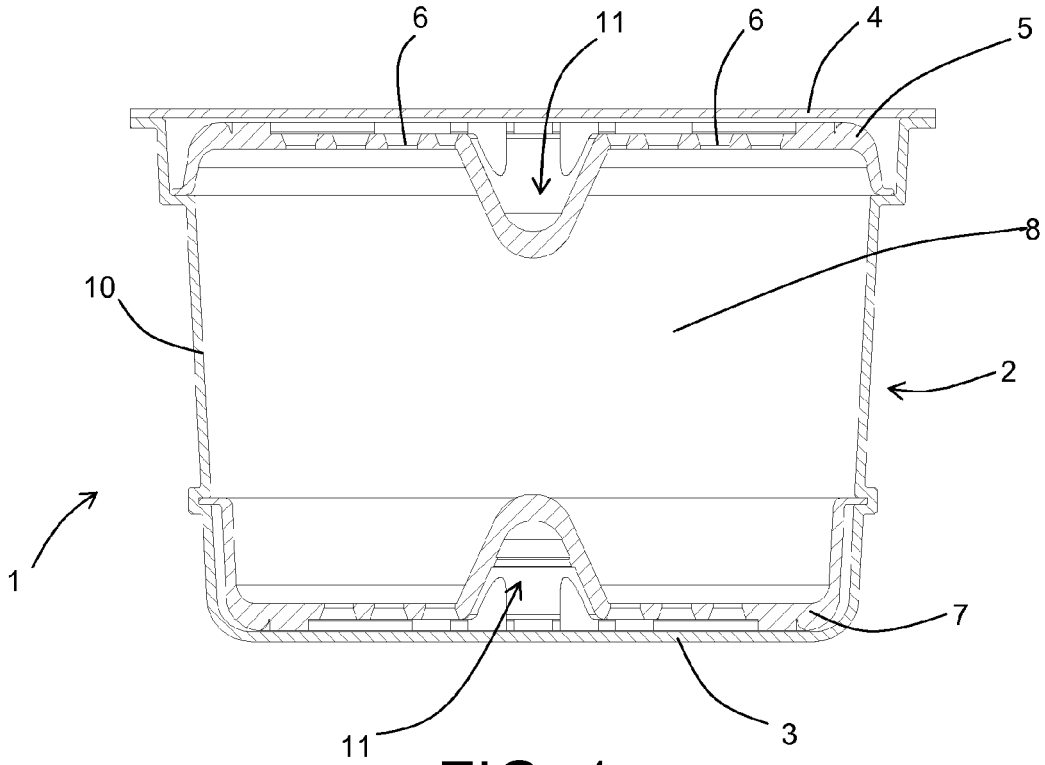
FIG. 1 is a vertical cross-section, without the powdered substance, of a first embodiment of a capsule in accordance with the present invention.
Figure 2:
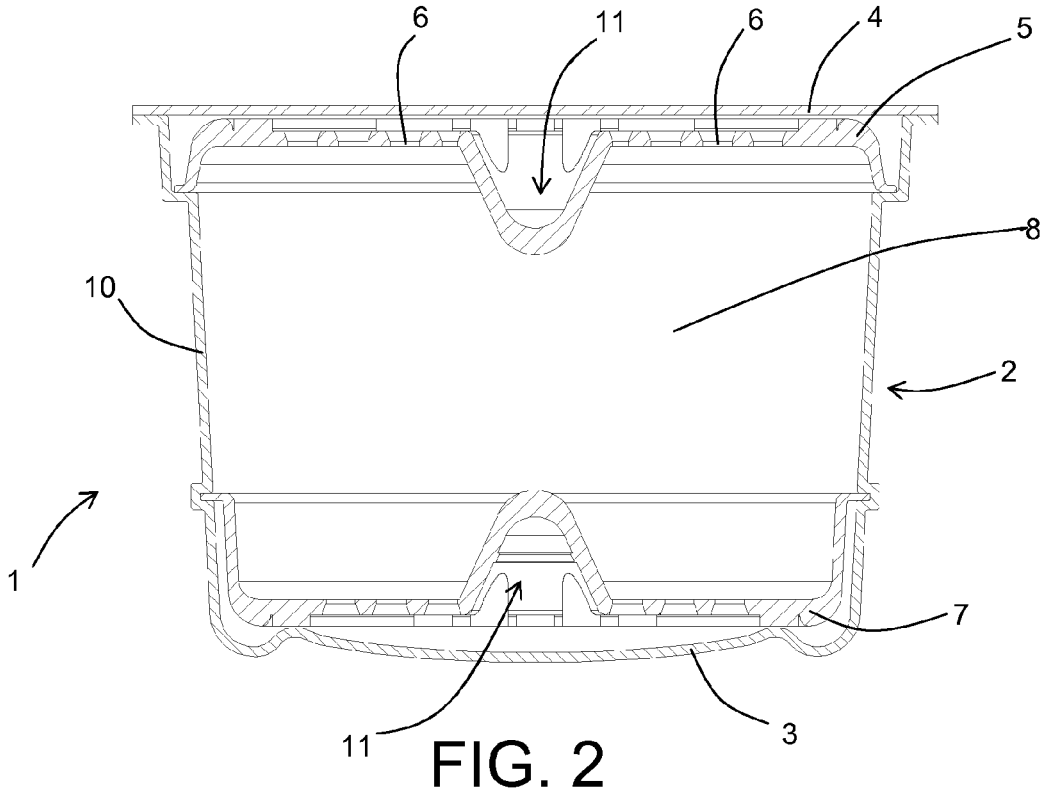
FIG. 2 is a vertical cross-section, without the powdered substance, of a second embodiment of a capsule in accordance with the present invention.

FIGS. 1 and 2 show two examples of capsules which can be made in accordance with the present invention, differing only as regards the shape of the lower part, which is flat in FIG. 1 and convex in FIG. 2.

They are capsules comprising a cup-shaped structure 2 having a lower wall 3 and closed at the top by a lid 4 joined to it.

Figure 3:
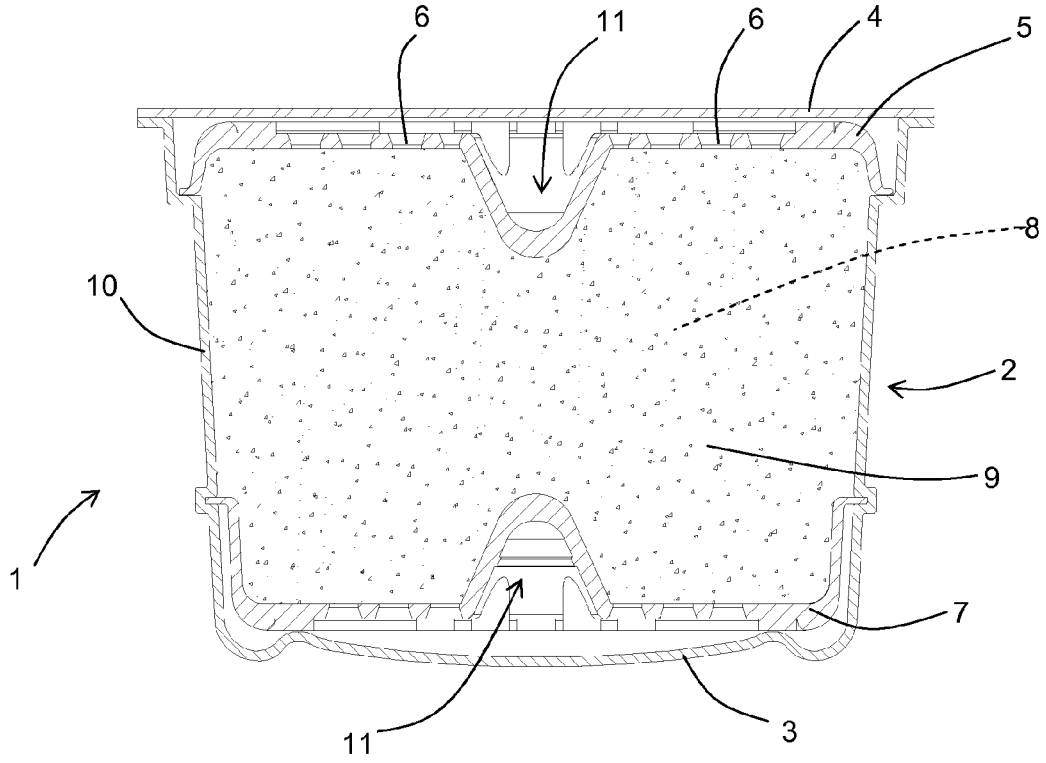
FIG. 3 shows the capsule of FIG. 2 with the powdered substance.
Figure 4:
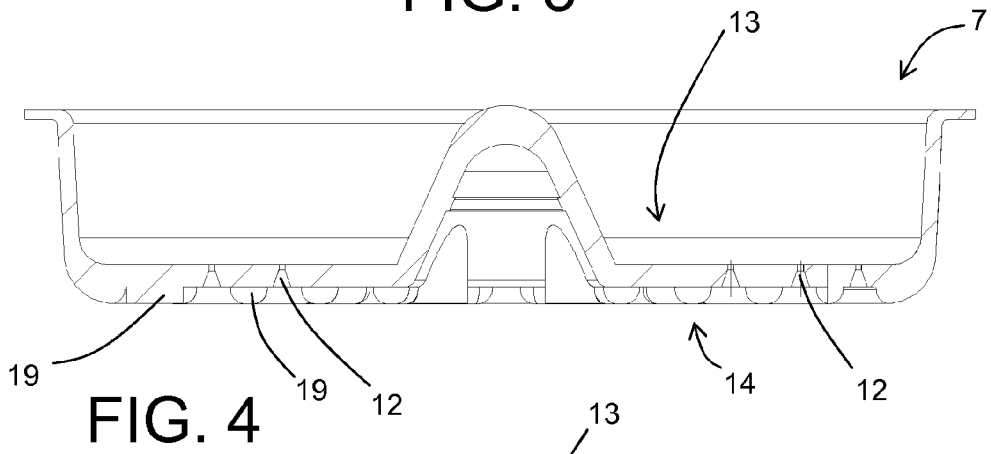
FIG. 4 is a vertical cross-section of a first embodiment of a filter element in accordance with the present invention.

Inside, each capsule 1 has a distribution element 5 for the liquid (which may even not be present), having a plurality of through-openings 6, the distribution element positioned opposite the lid 4, and a filter element 7 opposite the lower wall 3 of the cup-shaped structure 2. Therefore, between the filter element 7 and the distribution element 5 there is a chamber 8 which is completely or partly filled with the powdered substance 9 (as illustrated in FIG. 3 for the capsule 1 of FIG. 2). The chamber 8 is laterally delimited by a truncated cone-shaped lateral wall 10 of the cup-shaped structure 2.

Both the filter element 7 and the distribution element 5 have a conical central recess 11 designed to accommodate piercing means which, in practice, pierce the lid 4 and the base wall to allow respectively the liquid to enter and the drink to flow out. The recesses 11 prevent the piercing means from damaging the distribution element 5 or the filter element 7.

As already indicated, the present invention relates to the structural shape of the filter element 7 placed in a capsule 1 to retain at least most of the powdered substance 9.

Advantageously, the filter element 7 is a semi-rigid element made of plastic material (for example by moulding). The term "semi-rigid" is used here to indicate that the element has its own structural rigidity which allows it to be self-supporting, although it can also bend under the action of external forces (such as that generated by the water pressure in the capsule 1). In any case, rigid filter elements may also be used.

In accordance with the present invention, the filter element 7 has a plurality of through-holes 12 extending from its first face 13 facing the inside of the chamber 8 for the powdered substance 9 (and in contact with the powdered substance 9), to a second face 14 which, in the embodiments illustrated faces the lower wall 3 of the cup-shaped structure 2. Such through-holes 12 therefore have an inlet section 15 at the first face 13 directly in contact with the powdered substance 9, and an outlet section 16 at the second face 14.

In accordance with the present invention, the inlet sections 15 of the through-holes 12 extend according to a main trajectory of extension in such a way that they substantially have the appearance of slots. That is to say their length is greater than their width, where the length is measured along their main trajectory of extension, whilst the width is measured transversally to the main trajectory of extension (perpendicularly). Moreover, in some preferred embodiments the length of the inlet sections 15 is at least double the width, although smaller size ratios may be used.

Depending on the cases, the main trajectory of extension may extend in a straight fashion (as in the cases illustrated) or in a curved fashion (solution not illustrated).

Moreover, advantageously, the width of the inlet sections 15 is less than 0.4 mm, preferably than 0.25 mm, whilst the length is less than 5 mm, preferably than 2 mm. For example, there are embodiments of capsules for preparing coffee in which the through-holes 12 have a length of 1.5 mm and width of 0.2 mm.

In any case, the width of the inlet sections 15 must be selected in such a way that it is smaller than the size of most of the grains of the powdered substance 9, so that only a minimum part of the grains can pass beyond the filter element 7 (similarly to what happens with prior art filter elements).

In the case of single-dose capsules for preparing coffee, also advantageously the sum of the areas of the inlet sections 15 of all of the through-holes 12 made in the filter element 7 is between 15 and 30 $mm^2$. Typically, this corresponds to embodiments in which the filter element 7 comprises between 50 and 80 through-holes 12.

Depending on requirements, the through-holes 12 may be distributed on the filter element 7 in different configurations. For example, the accompanying drawings illustrate three different cases.

Figure 6:
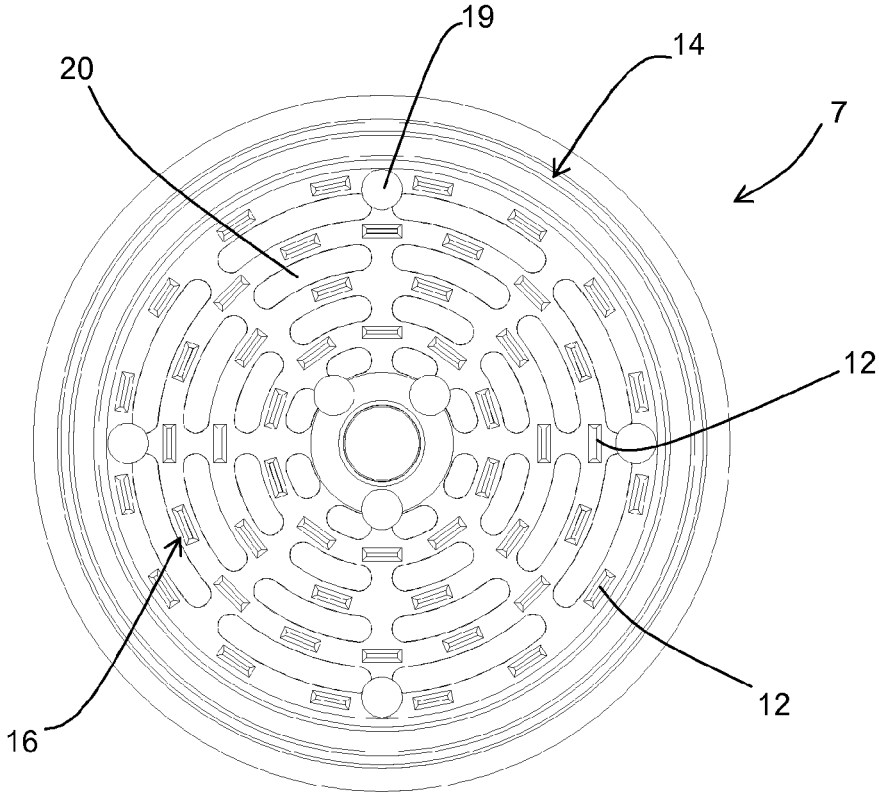
FIG. 6 is a bottom view of the filter element of FIG. 4.
Figure 7:
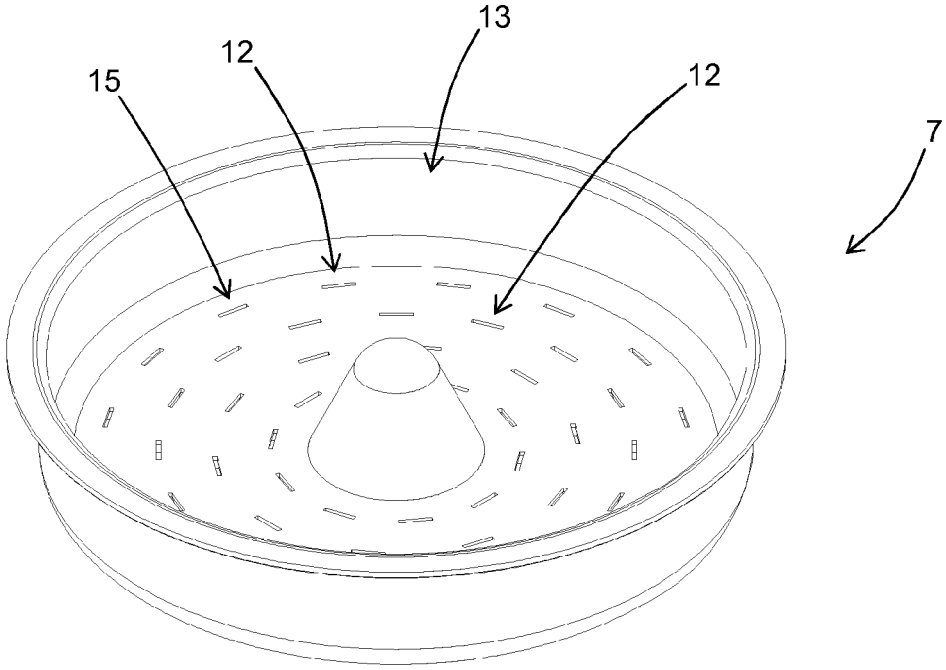
FIG. 7 is an axonometric three-quarter top view of the filter element of FIG. 4.

The first case, seen from the bottom in FIG. 6, is that of through-holes 12 distributed on the entire first face 13 along concentric circles and positioned with the inlet section 15 aligned with the circle on which they lie.

Figure 11:
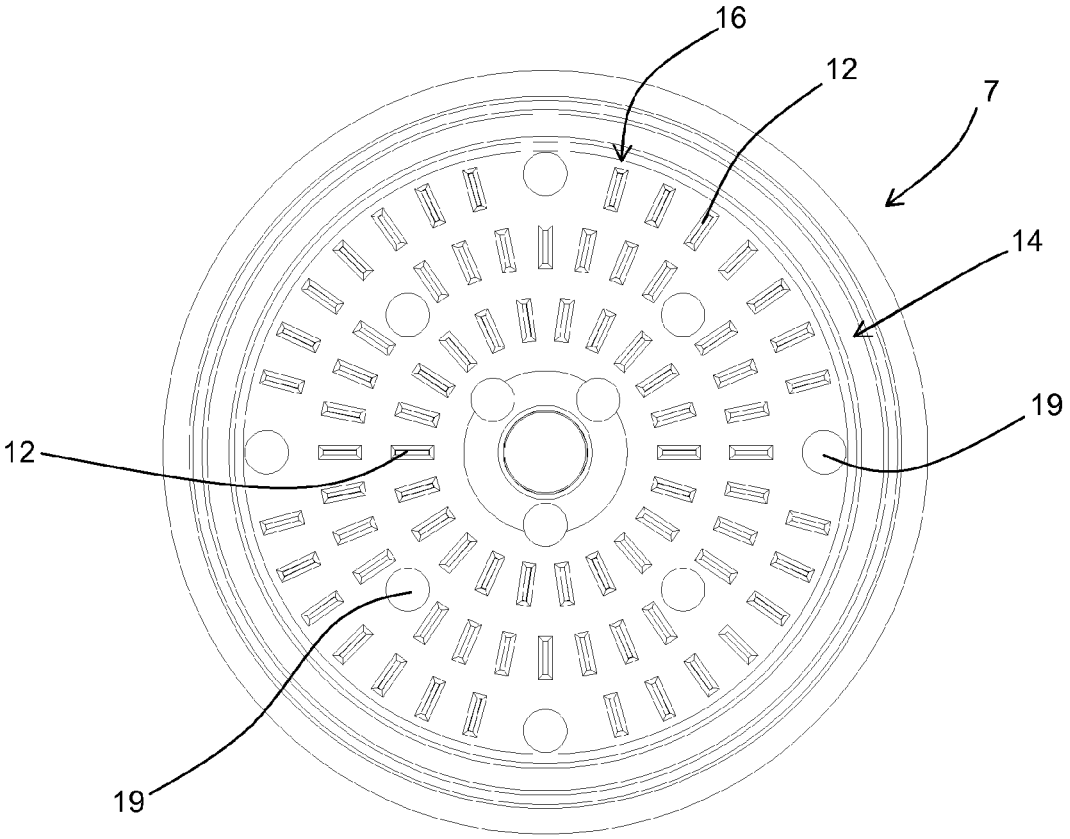
FIG. 11 is a bottom view of the filter element of FIG. 10.
Figure 12:
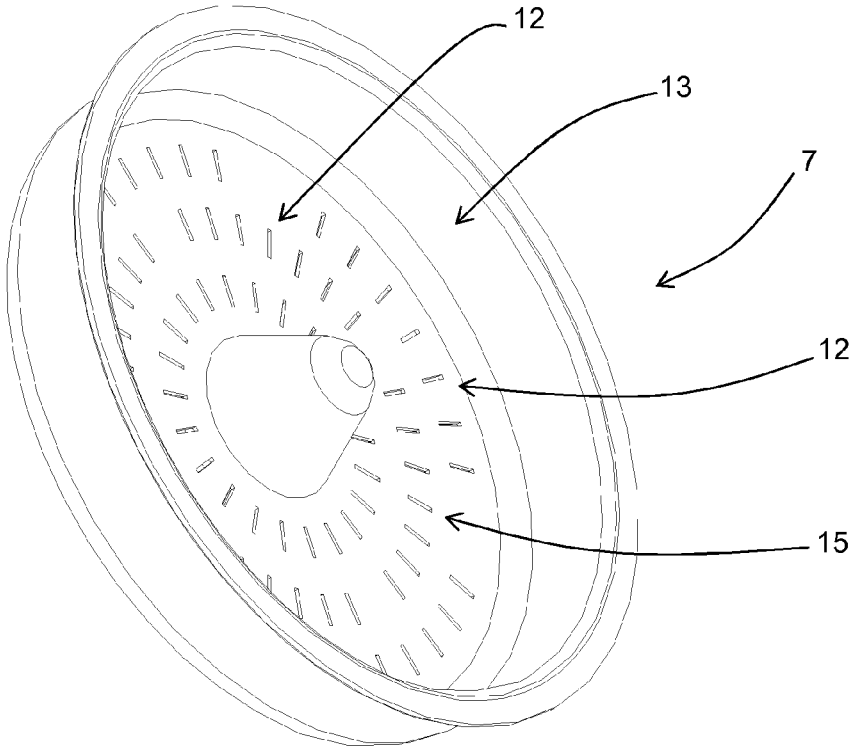
FIG. 12 is an axonometric three-quarter top view of the filter element of FIG. 10.

The second case, seen from the bottom in FIG. 11, differs from the first in that the through-holes 12 are positioned with the inlet section 15 aligned radially relative to the filter element 7.

In the third case the through-holes 12 are positioned in the same way as in the second case, but they are only distributed at a central portion of the filter element 7.

Figure 5:
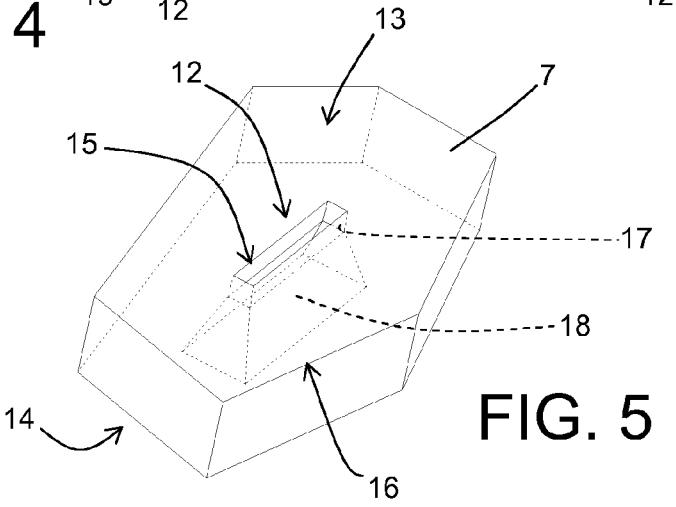
FIG. 5 is an axonometric enlarged view of a detail of a filter element made in accordance with the present invention.

FIG. 5 shows, with some parts transparent, a portion of the filter element 7 through which a through-hole 12 is made. As shown, the through-hole 12 has a transit cross-section which increases from the first face 13 towards the second face 14. In particular, it may be seen how, within the thickness of the filter element 7, the through-hole 12 has a first stretch 17 connected to the inlet section 15 and having a substantially constant transit cross-section, and a second stretch 18, joined to the first 17 and terminating with the outlet section 16, having the shape of a truncated pyramid which opens out towards the outlet section 16.

Such a shape advantageously facilitates expulsion of any grains of powdered substance 9 which, due to their extremely small size, may enter the through-hole 12.

Moreover, in accordance with the present invention the capsule 1 may also comprise a plurality of spacer elements 19 inserted between the second face 14 of the filter element 7 and the lower wall 3 of the cup-shaped structure 2 to keep them apart even in the event of their reciprocal deformation. Advantageously, the spacer elements 19 are integral with the filter element 7 and extend in a raised fashion from the second face 14.

Figure 9:
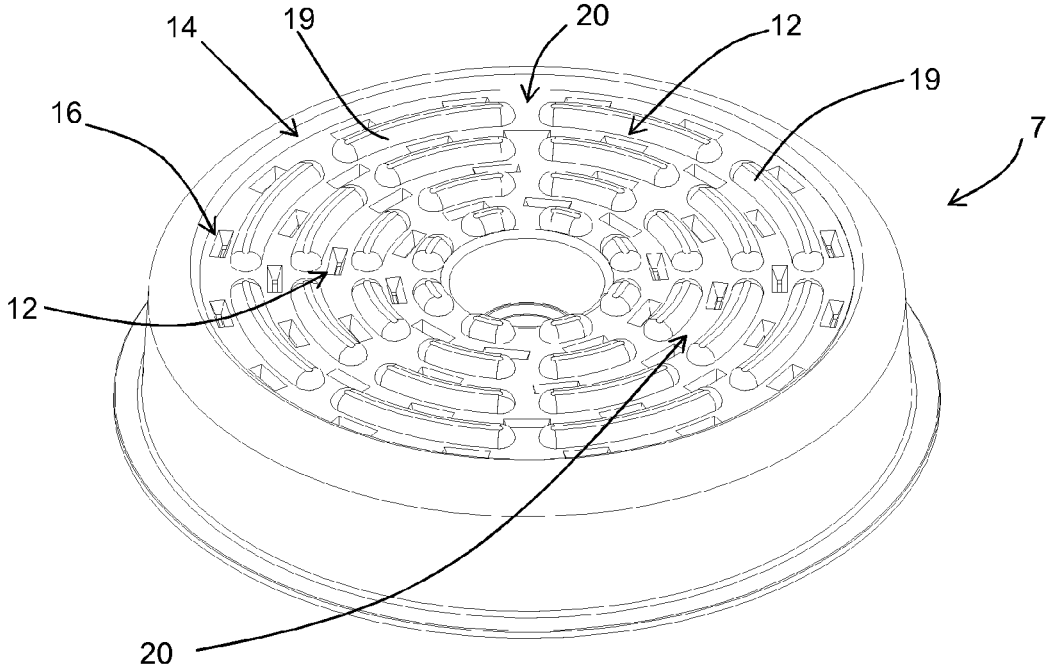
FIG. 9 illustrates an alternative embodiment of the filter element of FIG. 8.
Figure 10:
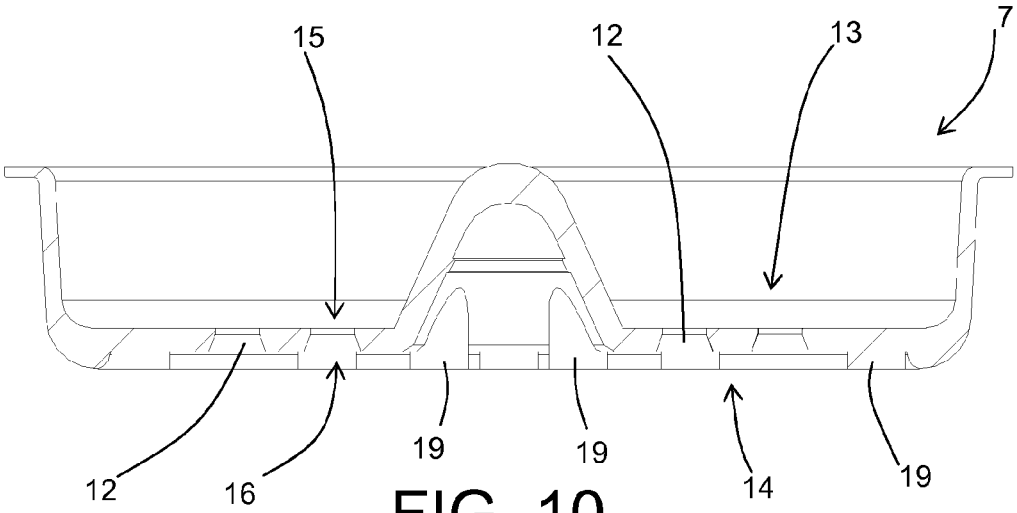
FIG. 10 is a vertical cross-section of a second embodiment of the filter element in accordance with the present invention.

In the embodiment illustrated in FIG. 9, the plurality of spacer elements 19 forms a plurality of channels 19 between the second face 14 of the filter element 7 and the lower wall 3 (channels 20 with circular and radial extension relative to the filter element 7).

Figure 13:
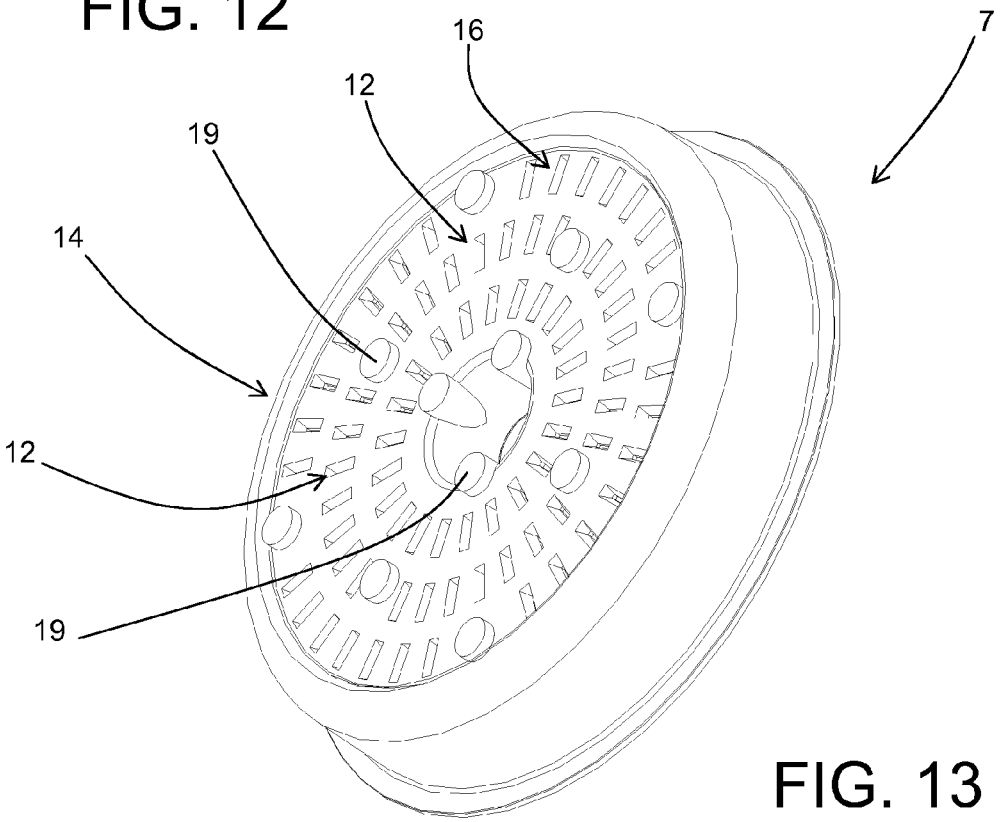
FIG. 13 is an axonometric three-quarter bottom view of the filter element of FIG. 10.
Figure 14:
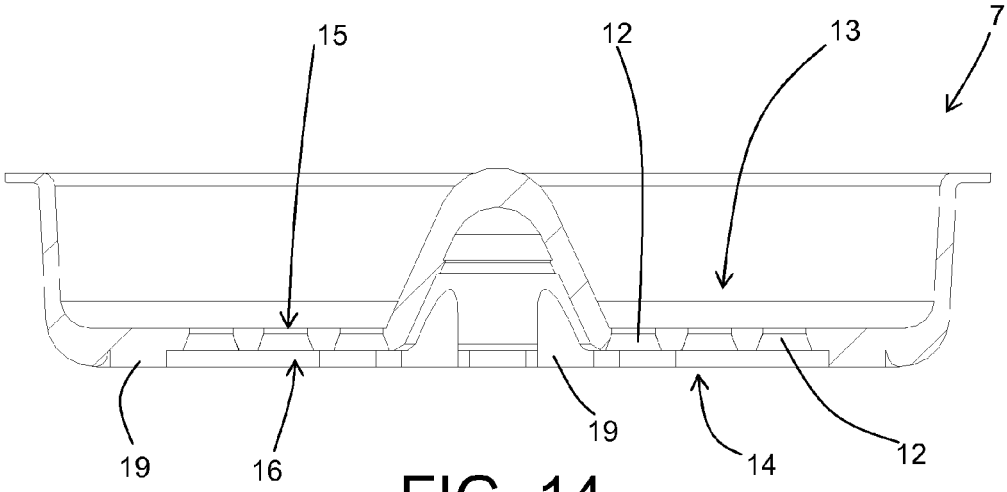
FIG. 14 is a vertical cross-section of a second embodiment of the filter element in accordance with the present invention.
Figure 15:
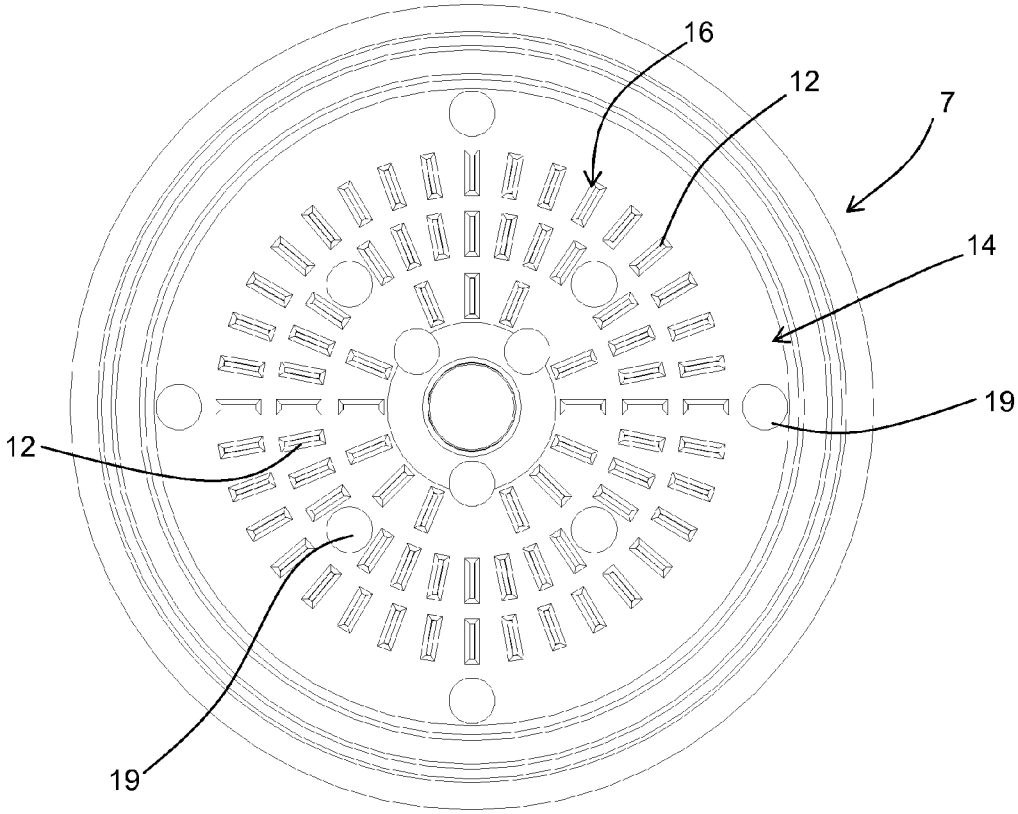
FIG. 15 is a bottom view of the filter element of FIG. 14.
Figure 16:
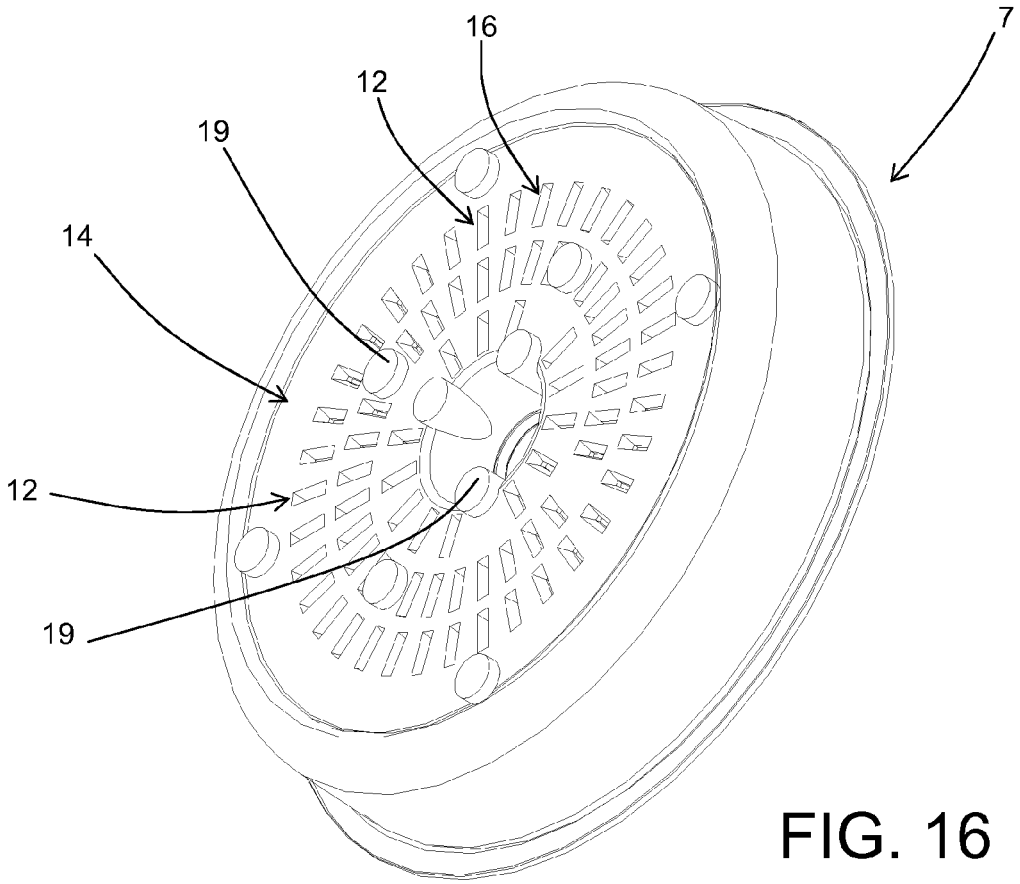
FIG. 16 is an axonometric three-quarter bottom view of the filter element of FIG. 14.
Figure 17:
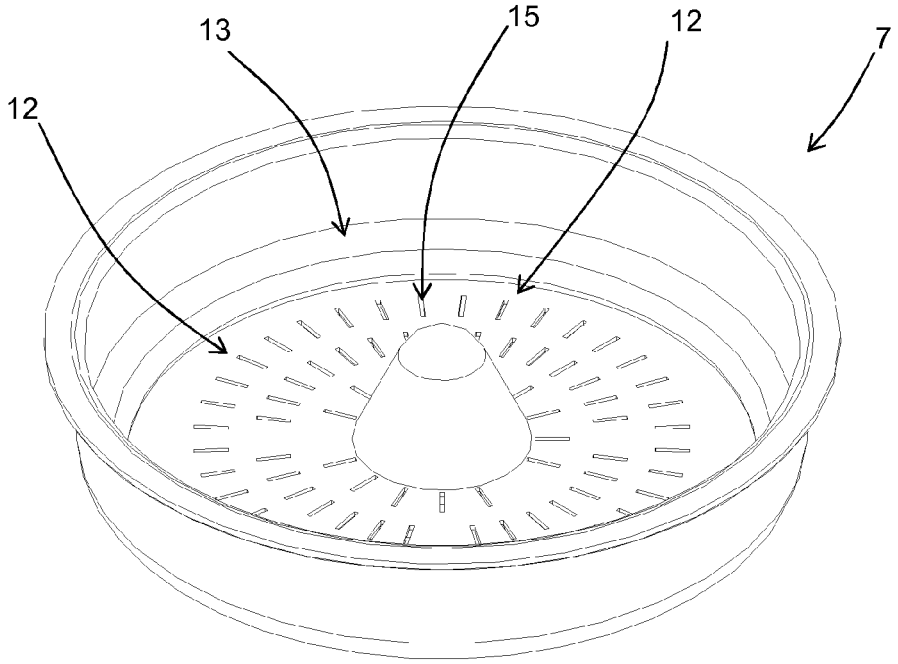
FIG. 17 is an axonometric three-quarter top view of the filter element of FIG. 14.

In the embodiments in FIGS. 13 and 16, the spacer elements 19 have a cylindrical shape (advantageously they also form the projections used for expelling filter elements from moulds during production).

Figure 8:
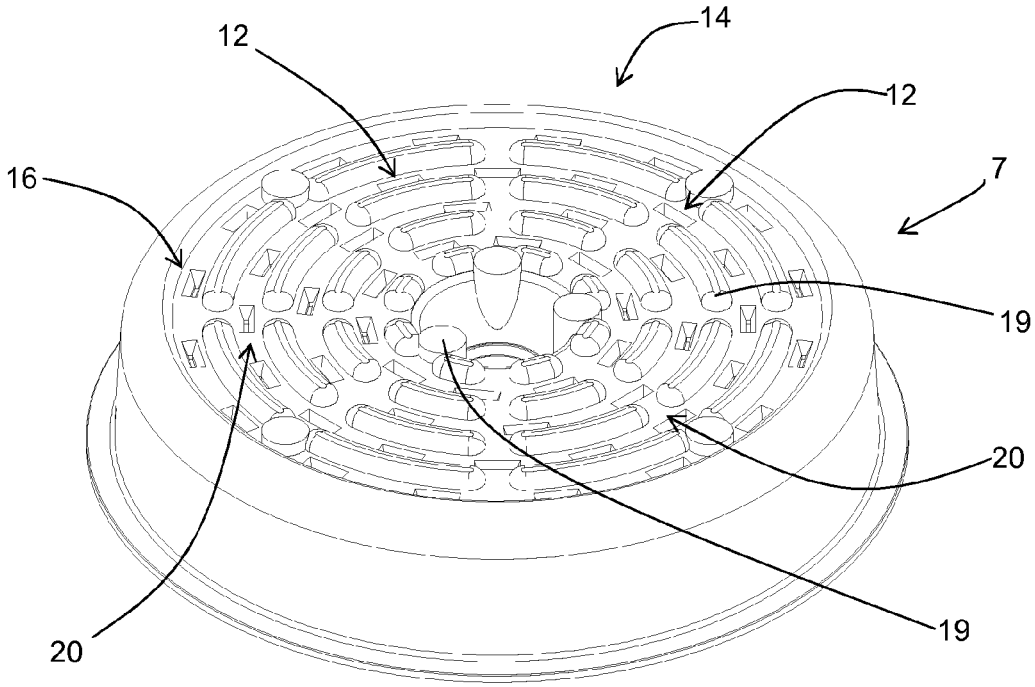
FIG. 8 is an axonometric three-quarter bottom view of the filter element of FIG. 4.

Finally, in the embodiment in FIG. 8, the two embodiments described above coexist.

Operation of the capsule 1 disclosed is the same as that of conventional capsules.

However, the present invention brings the important advantage of its filter element not being subject to clogging the way conventional filter elements are.

In conventional filter elements the grains of powdered substance (which may be likened to balls) may completely block the individual through-holes, since the latter are circular and have a diameter smaller than the grains. In contrast, in the case of the through-holes having the shape of a slot disclosed by the present invention, even when the grains of substance engage in the slots (whose width is less than most of the grains of substance), they behave like little balls partly inserted in a slot, therefore leaving gaps free between them.

It should also be noticed that the present invention is relatively easy to produce and even the cost linked to implementation of the invention is not very high.

The invention described may be modified and adapted in several ways without thereby departing from the scope of the inventive concept.

All details of the invention may be substituted by other technically equivalent elements and, in practice, all of the materials used, as well as the shapes and dimensions of the various components, may be any according to requirements.

The invention claimed is:

1. A capsule for preparing drinks by passing a liquid through a powdered substance (9) contained in a chamber (8) made inside the capsule (1), said capsule (1) comprising a cup-shaped structure (2) having a lower wall (3); the chamber (8) being delimited on at least one side by at least one filter element (7) having a plurality of through-holes (12) extending from a first face (13) of the filter element (7) facing the inside of the chamber (8), to a second face (14) of the filter element (7) facing the lower wall (3) of the cup-shaped structure (2), the capsule being characterised in that at least at the first face (13), the through-holes (12) have inlet sections (15) extending according to a main trajectory of extension and each having a length, measured along the main trajectory of extension, greater than their width, measured transversally to the main trajectory of extension.

2. The capsule for preparing drinks according to claim 1, characterised in that the width of the inlet sections (15) is less than 0.4 mm.

3. The capsule for preparing drinks according to claim 2, characterised in that the width of the inlet sections (15) is less than 0.25 mm.

4. The capsule for preparing drinks according to claim 3, characterised in that the length of the inlet sections (15) is less than 2 mm.

5. The capsule for preparing drinks according to claim 1, characterised in that the length of the inlet sections (15) is less than 5 mm.

6. The capsule for preparing drinks according to claim 1, characterised in that the sum of the areas of the inlet sections (15) of all of the through-holes (12) made in the filter element (7) is between 15 and 30 $mm^2$.

7. The capsule for preparing drinks according to claim 1, characterised in that the filter element (7) comprises between 50 and 80 through-holes (12).

8. The capsule for preparing drinks according to claim 1, characterised in that the trajectory of extension of the inlet sections (15) is straight and/or curved.

9. The capsule for preparing drinks according to claim 1, characterised in that at least some of the through-holes (12) are positioned on the filter element (7) according to concentric circles.

10. The capsule for preparing drinks according to claim 9, characterised in that at least some of the through-holes (12) are positioned with their inlet section (15) aligned with the circle on which they lie.

11. The capsule for preparing drinks according to claim 9, characterised in that at least some of the through-holes (12) are positioned with their inlet section (15) aligned radially relative to the filter element (7).

12. The capsule for preparing drinks according to claim 1, characterised in that the through-holes (12) have a transit cross-section which increases from the first face (13) towards the second face (14).

13. The capsule for preparing drinks according to claim 12, characterized in that it also comprises a plurality of spacer elements (19) inserted between the second face (14) and the lower wall (3) to keep them apart.

14. The capsule for preparing drinks according to claim 13, characterized in that the spacer elements (19) are integral with the filter element (7) and are raised relative to the second face (14).

15. The capsule for preparing drinks according to claim 1, further comprising a plurality of spacer elements (19) inserted between the second face (14) and the lower wall (3) to keep them apart.

16. The capsule for preparing drinks according to claim 15, characterised in that the spacer elements (19) are integral with the filter element (7) and are raised relative to the second face (14).

17. The capsule for preparing drinks according to claim 16, characterized in that said plurality of spacer elements (19) forms a plurality of channels (20) between the second face (14) of the filter element (7) and the lower wall (3).

18. The capsule for preparing drinks according to claim 16, characterized in that at least some of the spacer elements (19) have a cylindrical shape.

19. The capsule for preparing drinks according to claim 15 characterised in that said plurality of spacer elements (19) forms a plurality of channels (20) between the second face (14) of the filter element (7) and the lower wall (3).

20. The capsule for preparing drinks according to claim 15, characterised in that at least some of the spacer elements (19) have a cylindrical shape.

* * * * *